US006430879B1

(12) United States Patent
Nuiry et al.

(10) Patent No.: US 6,430,879 B1
(45) Date of Patent: Aug. 13, 2002

(54) COLLAPSIBLE HOUSING

(76) Inventors: Ramon A. Nuiry, 255 NE. Sierra Dr., Apt. 410, Miami, FL (US) 33179; Jorge Nuiry, 2510 SW. 29 Ave., Miami, FL (US) 33133

( * ) Notice: Subject to any disclaimer, the term of this patent is extended or adjusted under 35 U.S.C. 154(b) by 21 days.

(21) Appl. No.: 09/755,797

(22) Filed: Jan. 5, 2001

(51) Int. Cl.[7] ..... E04H 4/08; E04B 1/343; E04B 7/16

(52) U.S. Cl. ..... 52/67; 4/500; 4/498

(58) Field of Search ..... 4/500, 498; 52/67

(56) References Cited

U.S. PATENT DOCUMENTS

| | | | | | |
|---|---|---|---|---|---|
| 1,896,433 | A | * | 2/1933 | Windeknecht | |
| 3,415,260 | A | * | 12/1968 | Hall | 135/1 |
| 3,501,783 | A | * | 3/1970 | Broadman | |
| 3,745,725 | A | * | 7/1973 | Boucaud | 52/67 |
| 3,845,591 | A | * | 11/1974 | Stine | 52/67 |
| 4,271,644 | A | * | 6/1981 | Rilliet | 52/67 |
| 4,683,686 | A | * | 8/1987 | Ozdemir | 52/64 |
| 4,711,257 | A | * | 12/1987 | Kobayashi | |
| 4,784,429 | A | * | 11/1988 | Hodges | |
| 5,156,195 | A | * | 10/1992 | Wehler et al. | |
| 5,761,750 | A | * | 6/1998 | Mazzola et al. | 4/500 |
| 5,907,928 | A | * | 6/1999 | Charbonnel | 52/67 |
| 6,014,778 | A | * | 1/2000 | Varnado | 4/502 |

FOREIGN PATENT DOCUMENTS

| | | | | |
|---|---|---|---|---|
| CH | 149936 | * | 10/1931 | 52/67 |
| DE | 129116 | * | 7/1932 | 52/67 |
| DE | 2021896 | * | 5/1970 | 52/67 |
| DE | 4109584 | * | 10/1991 | E04H/4/10 |
| FR | 2273917 | * | 1/1976 | 52/67 |
| GB | 2026057 | * | 1/1980 | E04B/1/343 |
| GB | 2214945 | * | 9/1989 | 52/67 |

* cited by examiner

*Primary Examiner*—Robert Canfield
(74) *Attorney, Agent, or Firm*—J. Sanchelima

(57) ABSTRACT

A retractable cover for protecting designated area and spaces. A stationary rigid portion receives telescopically extending portions movable over guiding assemblies to house vehicles and other objects and protect them. When the telescopic rigid portions are fully extended, they engage and interlock with seals resulting in a water tight structure. Also, the engagement is used to move and/or stop contiguous portions through the use of outwardly extending tabs at the rear and front ends of the telescopic portions. The guiding assemblies include channels through which wheels that are rotatably mounted to the lowermost ends of the portions. The stationary portion can be mounted to a cover member that is hingedly mounted to the area adjacent to a cooperative hole for selectively housing the retractable cover.

7 Claims, 3 Drawing Sheets

COLLAPSIBLE HOUSING

BACKGROUND OF THE INVENTION

1. Field of the Invention.

The present invention relates to collapsible housing, and more particularly, to a retractable cover with telescopically extending portions movable over rails or wheels to house predetermined areas and spaces to protect them.

2. Description of the Related Art.

Applicant believes that the closest reference corresponds to U.S. Pat. No. 3,415,260 issued to Hall in 1968 for an Extensible Canopy Structure. However, it differs from the present invention because the present invention has retractable portions with telescopically extending rigid portions. The canopy in the patented structure does not provide the same degree of protection as in the present invention. Furthermore, to implement Hall's patent, as shown in FIG. 2, the canopy has to be made out of a very thin material. Otherwise, a very bulky body would develop, or else, it would have to be removed. The present invention provides a volumetric solution.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a telescopically extending cover structure that is easily movable to house predetermined areas and spaces to protect them and the objects within them such as vehicles, pools, and other objects and structures.

It is another object of this invention to provide a telescopic system with portions that engage and interlock with cooperative seals resulting in a water tight structure.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
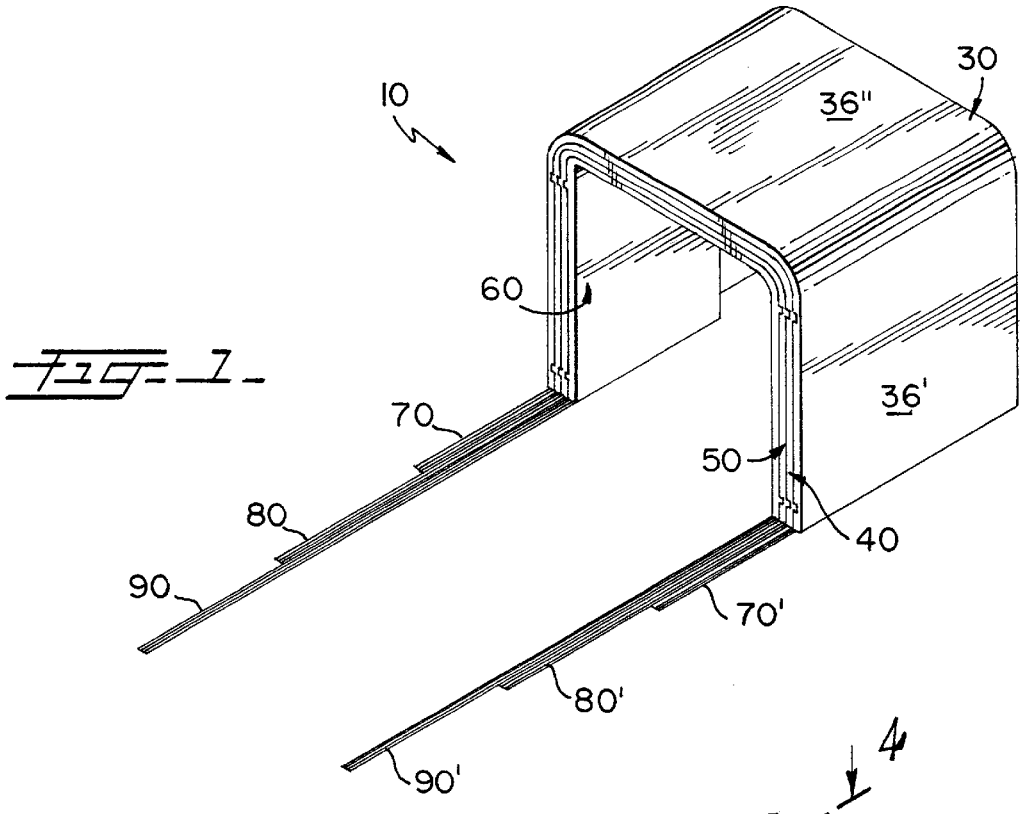
FIG. 1 represents an isometric view of the present invention in the retracted position.

Referring now to the drawings, where the present invention is generally referred to with numeral 10, it can be observed that it basically includes stationary portion 30, telescopic portions 40; 50 and 60, and guiding assemblies 70; 80; 90; 70'; 80' and 90'. Portions 30; 40; 50 and 60 include, side walls 36; 36'; 46; 46'; 56; 56'; 66 and 66' respectively, that are parallel and spaced apart relationship to each other. The side walls are perpendicularly mounted to top walls 36"; 46'"; 56" and 66".

As seen in FIG. 1, stationary portion 30 is anchored in place at a predetermined location. Portion 30 is shaped in such a way that it receives telescopic portions 40; 50 and 60 in the retracted position. Portion 30 is slightly larger in size with just enough internal clearance to allow telescopic portion 40 to fit within the former, and telescopic portion 40, similarly, is slightly larger in size than portion 50 and portion 50 is larger than portion 60 so that the former portions receive the latter portions when retracted. Portions 30; 40; 50 and 60 each include two spaced apart and parallel side walls 36; 46; 56 and 66 and top walls joining them. In the preferred embodiment, guiding assemblies 70; 80; 90; 70'; 80' and 90' can be implemented with channels on surface S. Guiding assemblies 70; 80; 90; 70'; 80' and 90' are of sufficient length to allow telescopic portions 40; 50 and 60 to fully travel predetermined distances.

Figure 2:
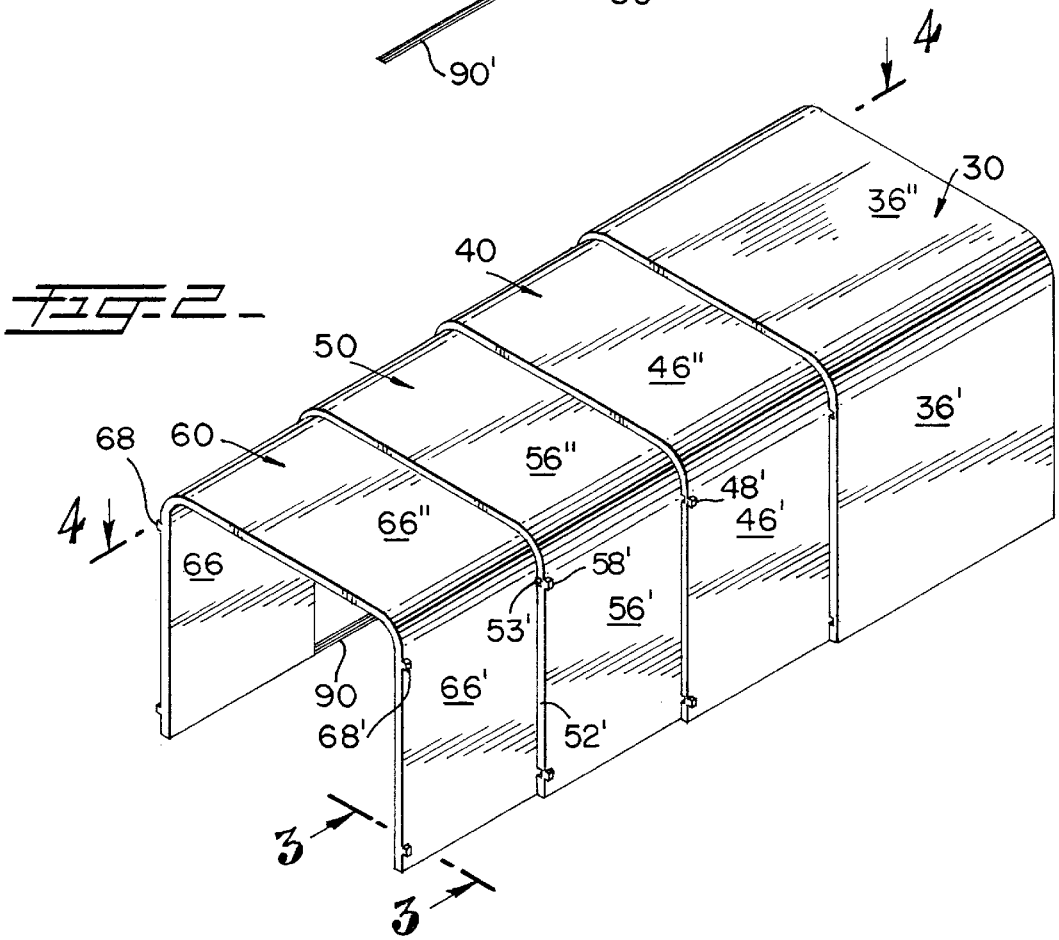
FIG. 2 shows an isometric view of the present invention in the extended position.

A seen in FIG. 2, telescopic portions 40; 50 and 60 are fully extended. Telescopic portion 40 is movable over guiding assemblies 70, and 70'. Telescopic portion 50 is movable over guiding assemblies 80 and 80'. Guiding assemblies 80 and 80' extend a distance equal to the length of assemblies 70 and 70' plus the length of portion 50. In the same manner, guiding assemblies 90 and 90' extend a distance equal to the length of assemblies 80 and 80' plus the length of portion 60. Guiding assemblies 70; 80 and 90 (and 70'; 80' and 90') are disposed in parallel and spaced apart relationship with respect to each other and extend a predetermined distance within portion 30 that is at least the length of portions 40; 50 and 60. In one of the applications, like the one shown in FIGS. 1 and 2, the present invention has cooperative dimensions to house a vehicle and protect it from the natural elements, such as sunlight, rain, wind, and hail.

Figure 3:
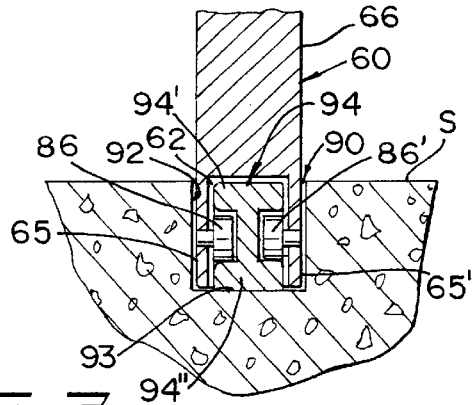
FIG. 3 is a representation of a cross sectional view of an end of one of the portions taken along line 3—3 in FIG. 2 showing the wheel and rail assembly.

FIG. 3 illustrates one of the preferred embodiments for guiding assemblies 90 and 90' (which can also be used for assemblies 80 and 80'; 70 and 70'). Channel 92 includes a substantially flat bottom surface 93 supporting longitudinally extending I-beam 94 with upper and lower flanges 94' and 94" at a spaced apart and parallel relationship with respect to each other. The lowermost end of portion 60 includes longitudinally extending cavity 62 with opposite surfaces kept at a spaced apart and parallel relationship with respect to each other. Wheels 86 and 86' are rotatably mounted to walls 65 and 65'. Wheels 86 and 86' ride over flange 94" and their vertical movement is limited by upper flange 94'. In this manner, telescopic portion 60, for instance, can be readily moved along guiding assembly 90.

Figure 4:
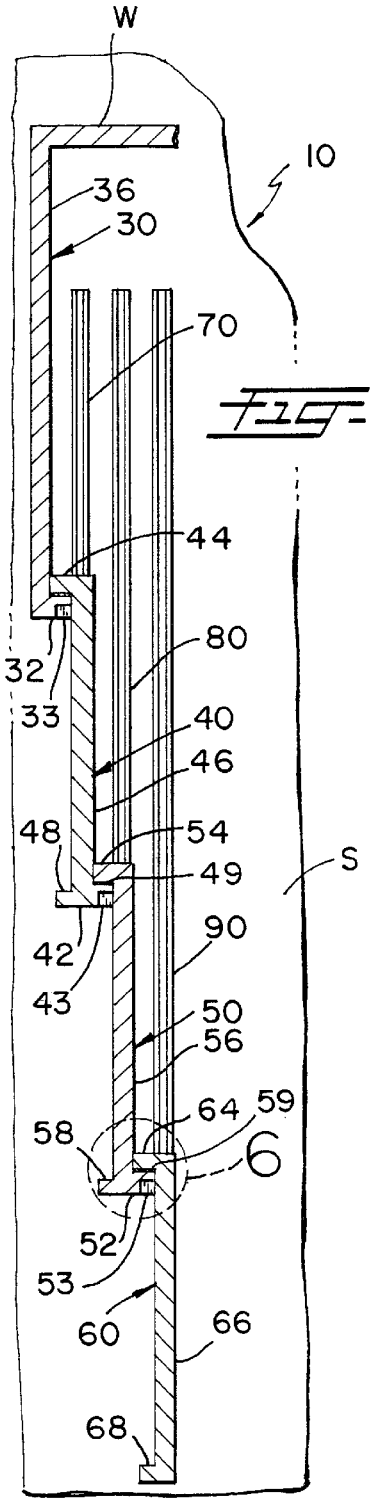
FIG. 4 illustrates a cross sectional top view of the invention taken along line 4—4 in FIG. 2 showing the engagement and adjoining partitions.

As best seen in FIG. 4, a partial cross-section of retractable cover 10 is shown in the expanded or extended position.

Stationary portion 30 is anchored to a fixed location, typically against a stationary wall W. Front end wall 32, perpendicularly mounted to wall 36, serves to stop telescopic portion 40 at a predetermined distance when the latter is expanding by making contact with rear end wall 44, which is perpendicularly mounted to wall 46. Also, perpendicularly mounted to wall 46 is front end wall 42. Front end wall 42 extends outwardly defining tab 48 and inwardly with end wall section 49. Tab 48 serves to stop telescopic portion 40 at a predetermined distance by making contact with front end wall 32 in the retracted position.

Similarly, wall section 49 engages with rear end wall 54 when the housing is being retracted. Rear end wall 54 is perpendicularly mounted to wall 56 of telescopic portion 50. When retracting the present invention, stopper tab 48 makes contact with wall 32 (and being lodged within cavity 33) to stop the retracting movement of telescopic portion 40. Telescopic portion 50, when retracted, fits within telescopic portion 40. Similarly, front end wall 52, perpendicularly mounted and slightly extending beyond wall 56, includes outwardly extending tab 58 that makes contact with front end wall 42. Wall section 59 engages with rear wall 64 when the housing is being retracted. In the preferred embodiment, tabs 48, 58 and 68 are received within cavities 33, 43 and 53, respectively. In this manner, the front of portions 30, 40, 50 and 60 are flush when retracted, thereby retracting telescopic portion 40. In the same manner, portion 60 fits within portion 50 and tab 68 makes contact with front end wall 52 when retracting. Additional telescopic portions may be added or deleted utilizing the system described above, depending on the requirements.

Figure 5:
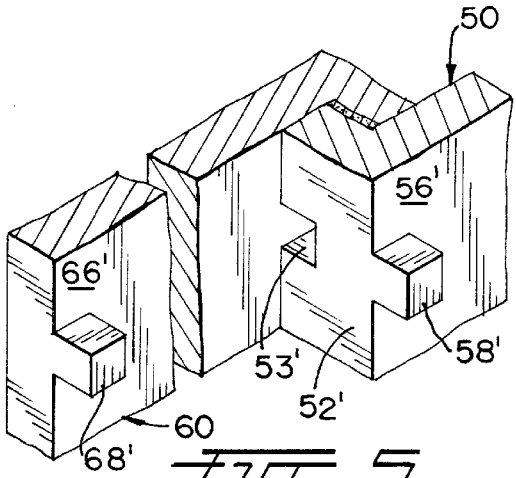
FIG. 5 is a broken detail isometric view of the stopper tabs and cavities receiving the tabs on the longitudinal walls opposite to those shown in FIG. 4.
Figure 6:
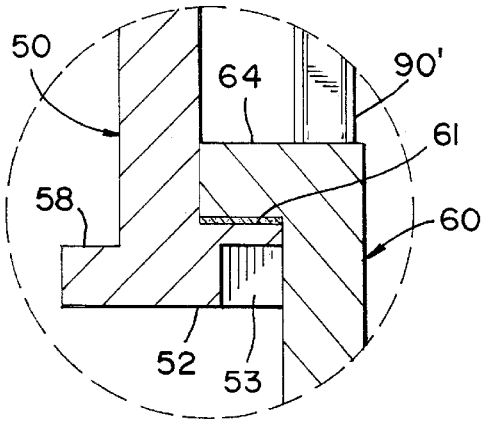
FIG. 6 represents a detailed view of the stopper tabs taken from circle 6 in FIG. 4.

In FIG. 5 a portion of the engagement between portions 50 and 60 is shown. The primed numbers are used since they correspond to the opposite side as those shown in FIG. 4. Stopper tab 68' is received within cavity 53'. The engagement of wall 66' with wall 56' is water tight, in the preferred embodiment, or at least substantially water tight. This can be accomplished with a sealing member that could be foam 61 mounted, or equivalent material, on rear wall 64, as shown in FIG. 6. This is similarly done in rear walls 44 and 54 to accomplish the sealing function.

In FIG. 6 a detail of the engagement between telescopic portions 50 and 60 is shown in the expanded position. The relative dimensions of the different elements are represented a little exaggerated. Preferably tighter spacing and clearances provide a better and more volumetrically efficient structure.

Figure 7:
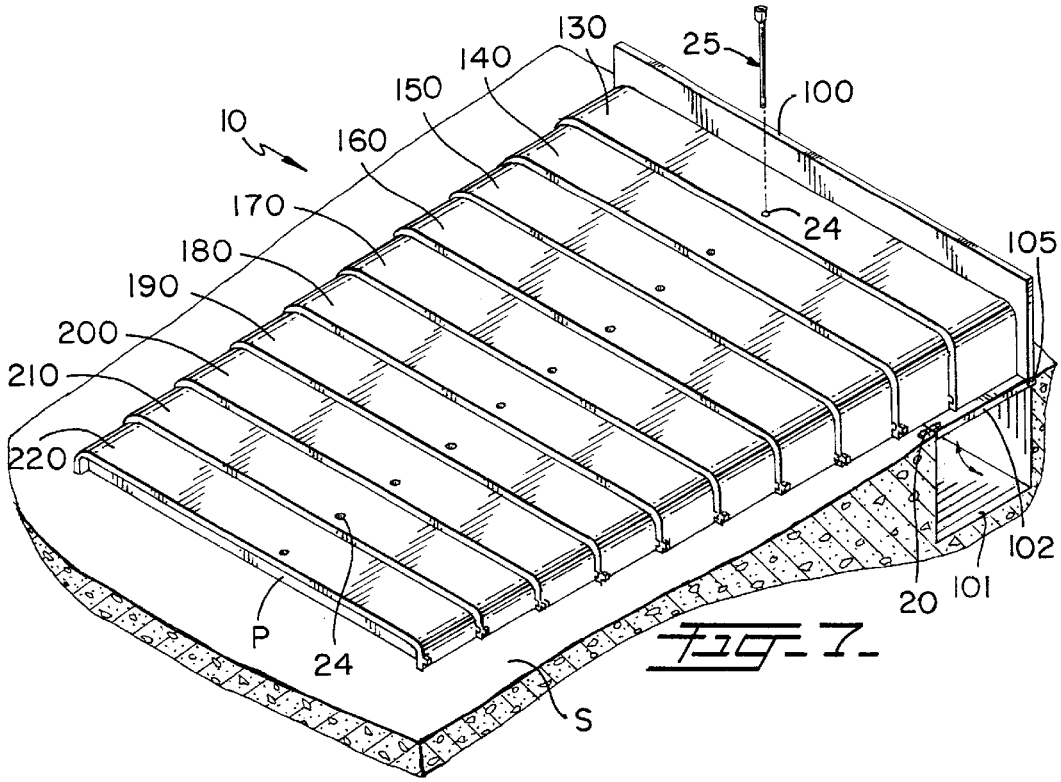
FIG. 7 shows an isometric view of another embodiment represented in FIG. 6 for the present invention in the extended position.
Figure 8:
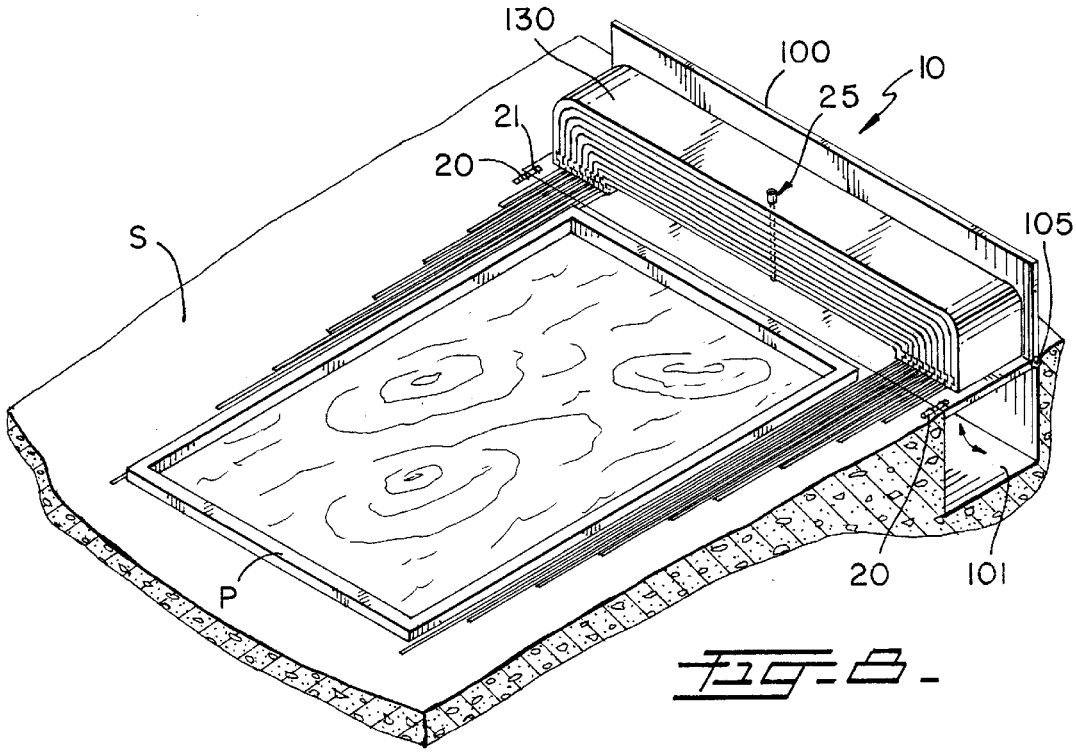
FIG. 8 represents an isometric view of another embodiment for the present invention in the retracted position.

FIGS. 7 and 8 represent another embodiment for the present invention, in expanded and retracted positions, respectively, where the portions have different dimensions to be used for another purposes, such as for protecting swimming pools P. This configuration may additionally include a hole 101 in surface S for storage purposes. Stationery portion 130 is rigidly mounted to wall 100. Base member 102 is perpendicularly mounted to wall 100 and provided with hinge assembly 105 at one of its longitudinal vertex. In the retracted position, all the telescopic portions are housed within stationary portion 130. Wall 100 can then be pivoted and brought to the same plane as surface S. The entire structure is hidden inside longitudinal cavity 101 returning usable area while providing storage convenience. Hole 101 is provided for convenient storage purposes.

Telescopic portions 40; 50 and 60, once retracted, interlock each other through tabs 48; 58 and 68 and cavities 33; 43 and 53. Portion 40 engages stationary portion 30 through tab 48 and cavity 33. The group of these portions, being interlocked to each other, are then rotated inside base member 101 after removing pins 20. Pins 20 have cooperative dimensions and strength characteristics to be inserted through loops 21 to withstand a predetermined weight of the entire assembly. To keep the different portions interlocked, pin member 25 is inserted through holes 24 in each one of portions 140; 150; 160; 170; 180; 190; 200; 210 and 220, as seen in FIG. 7.

Present invention 10 is made of a durable material such as fiberglass, aluminum or the like, and made to withstand natural weather elements, and intrusions such as flying objects (balls, etc.), trespassers or accidents that could damage the protected property.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A retractable cover for protecting an area of a surface, comprising:

A) a stationary portion having two first longitudinal rigid walls including first front and rear ends and disposed at a parallel and spaced apart relationship with respect to each other and each of said first longitudinal rigid walls having a first lowermost longitudinal end and a first uppermost longitudinal end, and further including a first elongated top rigid wall connecting said first uppermost longitudinal ends;

B) at least one telescopic portion having two second longitudinal rigid walls each including second front and rear ends and disposed at a parallel and spaced apart relationship with respect to each other and each of said second longitudinal rigid wall having a second lowermost longitudinal end and a second uppermost longitudinal end, and further including a second longitudinal top rigid wall connecting said second uppermost longitudinal ends and said telescopic portion having cooperative dimensions to be receivable within said stationary portion; and C) guiding means for keeping the movement of said telescopic portion within a cooperative path so that said telescopic portion is receivable within said stationary portion in one extreme position and outside said stationary portion in the other extreme position, further including a longitudinal hole and a hingedly mounted cover member with cooperative dimensions to close said hole and the rear end of said stationary portion being mounted to said cover member so that when said cover member is in the same plane as said surface said retractable cover is housed completely within said hole.

2. The retractable cover set forth in claim 1 further includes:

D) means for sealing said stationary and telescopic portions when the latter is positioned outside the former.

3. The retractable cover set forth in claim 2 wherein said guiding means includes at least one channel for each of said second longitudinal rigid walls and at least one cooperative wheel rotatably mounted to each of said second lowermost longitudinal ends and being guided within said channel.

4. The retractable cover set forth in claim 3 further including:

E) a longitudinal cavity in said surface defining a peripheral edge;

F) a rigid wall member hingedly mounted to said edge and rigidly mounted to the first rear ends of said stationary portion so that in the retracted position the entire retractable cover is rotated and housed within said longitudinal cavity.

5. The retractable cover set forth in claim 4 wherein said rigid wall member including a perpendicularly mounted base member for supporting said portions in the retracted portions.

6. The retractable cover set forth in claim 5 further including:

c) means for interlocking said portions in the retracted position inside each other.

7. The retractable cover set forth in claim 6 further including:

H) means for releasable locking said base member in the same plane as said surface.

* * * * *